US005113931A

United States Patent [19]

Oswalt et al.

[11] Patent Number: 5,113,931

[45] Date of Patent: * May 19, 1992

[54] HEAT TRANSFER APPARATUS

[75] Inventors: Philip D. Oswalt; Ronald A. Wolfe, both of Indianapolis, Ind.

[73] Assignee: Advantage Engineering, Inc., Greenwood, Ind.

[ * ] Notice: The portion of the term of this patent subsequent to Mar. 10, 2009 has been disclaimed.

[21] Appl. No.: 673,085

[22] Filed: Mar. 21, 1991

Related U.S. Application Data

[63] Continuation-in-part of Ser. No. 626,903, Dec. 13, 1990.

[51] Int. Cl.[5] ..... F24H 1/12

[52] U.S. Cl. ..... 165/78; 165/120; 165/65; 417/243; 392/473; 392/488; 392/489; 415/178

[58] Field of Search ..... 165/120, 104.31, 78, 165/65; 417/243; 415/121.3, 177, 178, 179; 392/471, 473, 488, 489

[56] References Cited

U.S. PATENT DOCUMENTS 1,882,266 10/1932 Wainwright ..... 417/243
2,377,027 5/1945 Morgan et al. ..... 392/471
4,129,178 12/1978 Hucke ..... 392/471

FOREIGN PATENT DOCUMENTS 698802 1/1932 France ..... 415/179

*Primary Examiner*—Albert W. Davis, Jr.
*Attorney, Agent, or Firm*—Woodard, Emhardt, Naughton, Moriarity & McNett

[57] ABSTRACT

A combination pump and heat exchanger assembly in a manufacturing process temperature controller uses a cast metal pump case with two upwardly opening sockets receiving the lower ends of two tubes, one of them communicating through the case with the pump impeller intake and the other with the impeller discharge. Closed circuit and open circuit versions are shown. In both types, the tubes are constructed to function as tanks, at least one being a heat exchanger unit, and they are readily and removably secured to the case by threaded fasteners and are sealed therein by compression seals. The heat exchanger tubes employ electrical heating elements or chilled liquid piping units therein. A controller including a microcomputer responds to temperature of liquid pumped from the assembly through a process to be temperature controlled, and returned to the assembly, to control an electric heater and/or a motor-operated modulator valve discharging to drain while cool make-up water is admitted. The combination is self-contained and wheel mounted for mobility to facilitate connection to and disconnection from the process equipment.

20 Claims, 6 Drawing Sheets

HEAT TRANSFER APPARATUS

BACKGROUND OF THE INVENTION

This application is a continuation-in-part of application Ser. No. 07/626,903, filed Dec. 13, 1990.

This invention relates generally to heat transfer systems, and more particularly to a pump and heat exchanger assembly which is compact and easily maintained.

DESCRIPTION OF THE PRIOR ART

Typical heat exchanger systems for controlling the temperature of cooling water for various kinds of manufacturing machines employ fabricated tanks with heating and/or cooling coils in them and which are piped into a process water plumbing circuit including a pump, various valves and controls. The tanks involve a considerable amount of fabrication. Their combination with pumps and the associated plumbing also involves considerable labor, space demands, and the attendant problems of packaging into reasonably sized units, particularly where portability of the temperature controller assembly is desirable. There are also attendant maintenance problems.

SUMMARY OF THE INVENTION

Described briefly, according to a typical embodiment of the present invention, a combination pump and heat exchanger assembly is provided with the pump case serving as the mount for heat exchanger units and for the pump drive motor. The pump case has upwardly opening receptacles, one communicating with the pump intake and the other with the pump discharge. A tank unit is mounted in each of the receptacles and is removably secured therein by threaded fasteners and sealed therein by compression seals. At least one of the tank units serves as a heat exchanger and may employ an electrical or other heater or chilled liquid piping therein. The heat exchanger is removable and replaceable as a unit. A microprocessor-controlled, motor-operated modulating valve is associated with one of the tank units to discharge overheated water from a process cooling circuit to waste drain. Fresh water make-up is provided. A temperature sensor for the water to the process is coupled to the controller.

DESCRIPTION OF THE PREFERRED EMBODIMENT

Figure 1:
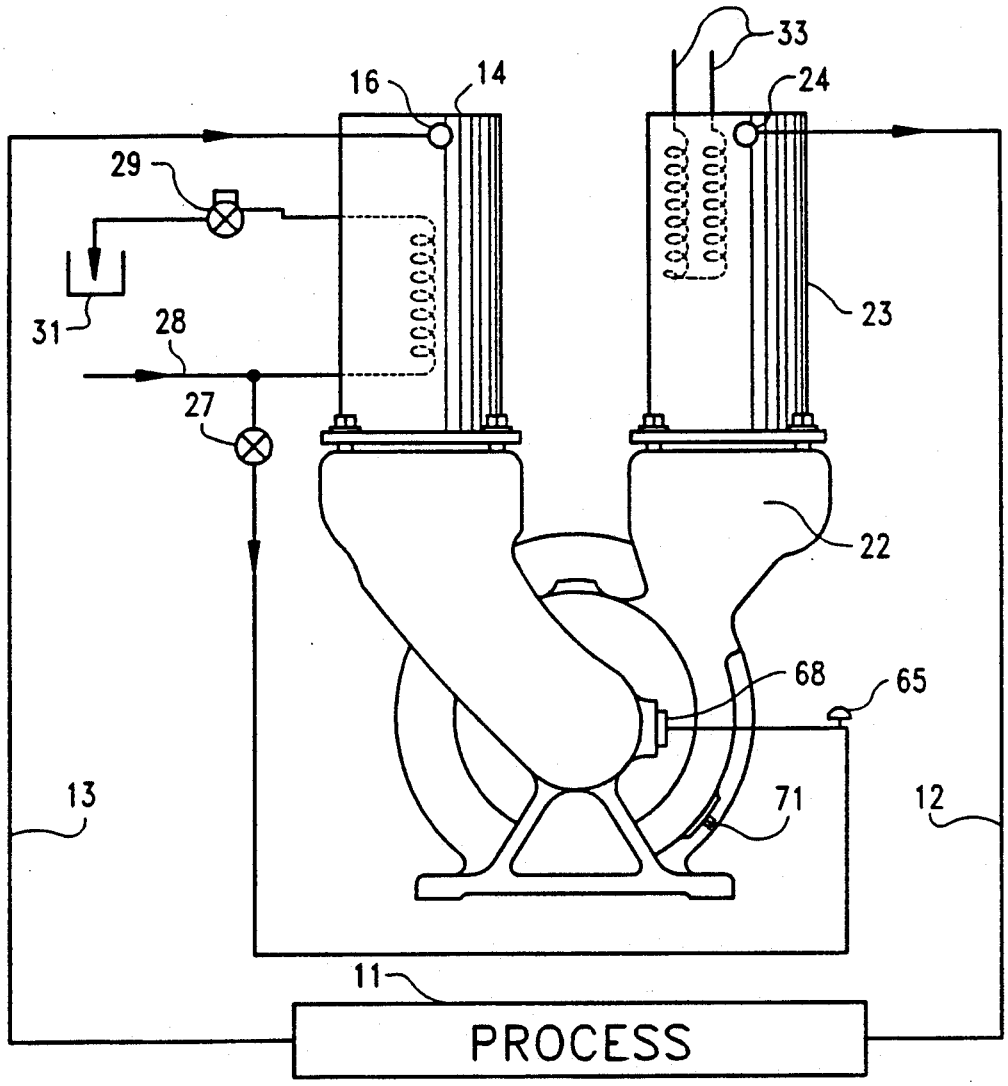
FIG. 1 is a symbolic diagram of a "closed circuit" process cooling water system including the pump and heat exchanger assembly of the present invention therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
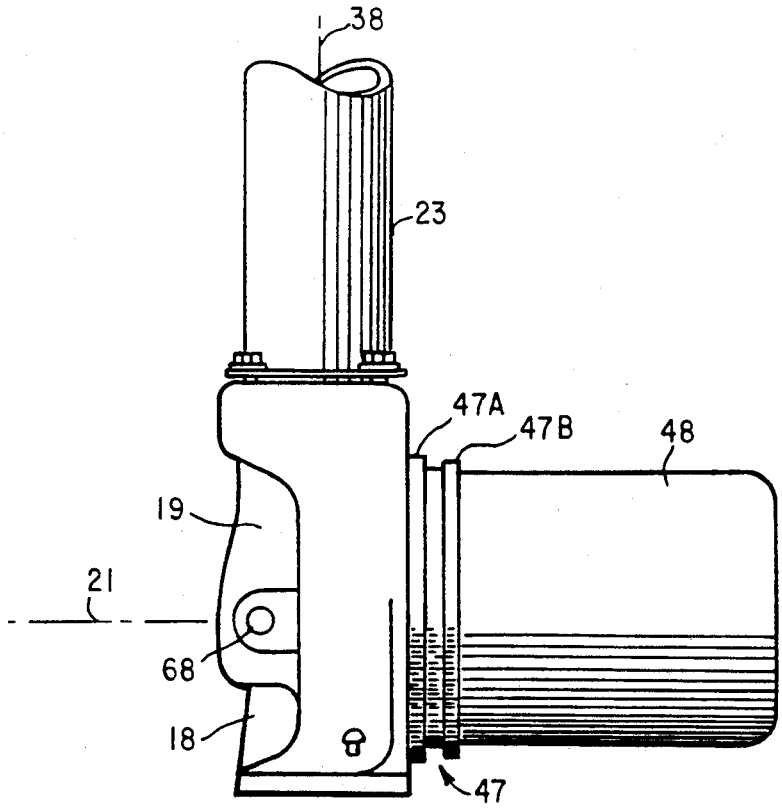
FIG. 4 is a small side elevational view of the pump and heat exchanger assembly with the upper portion of the heat exchangers eliminated to conserve space in the drawing, and showing the pump motor and adaptor mounted to the rear of the pump case.

Referring now to FIG. 1, the process equipment to be temperature-controlled is shown generally at 11. It may include injection molding machines, lasers, or other equipment requiring temperature control and in which water is usually used as the temperature controlling fluid. Water is supplied to the process through the line 12 and departs the process through the line 13 and enters the tank 14 through a spud opening 16 at the cylindrical wall thereof near the top. Tank 14 is received in an upwardly-opening receptacle 17 in the pump case 18 and which communicates through the passageway 19 to the pump intake on the axis 21 (FIGS. 4 and 5), so tank 14 may be referred to as the "suction" tank. The water is discharged through a similar upwardly opening receptacle 22 in which is received a "discharge" tank 23. In this FIG. 1 illustrated example, the process water is in a closed circuit. Therefore, a spud opening at 24 near the top of tube 23 is connected to the discharge line 12 supplying the process 11. Tanks 14 and 23 are steel tubes closed at their upper ends in a manner to be described. In this example, both tanks serve as heat exchanger tanks. Tank 14 is provided with internal means for cooling the water passing through it from the spud 16 into the pump case 18. The tank 23 is provided with means for heating the water discharged from the pump and departing through the spud 24. More specifically, a coiled tube 26 in heat exchanger tube 14 receives water from a city water supply 28. This water moves upward in tube 26 and exits near the upper end of tube 26 and passes through a motor operated valve 29 which discharges to the sewer 31. A manually operable valve 27 in a branch line from the water supply 28 to the pump case is used to fill the process temperature controlling water system. It should be understood that a closed circuit system could also be employed in which a tube and shell heat exchanger would be placed in series in line 13 and connected to a cooling water source and drain in the same manner as shown for coil 26 in FIG. 1. In that case, coil 26 could be eliminated from tank 14.

In the discharge tank 23, there is an electrical heating element 32 supplied by electrical power applied across the terminals 33.

Figure 2:
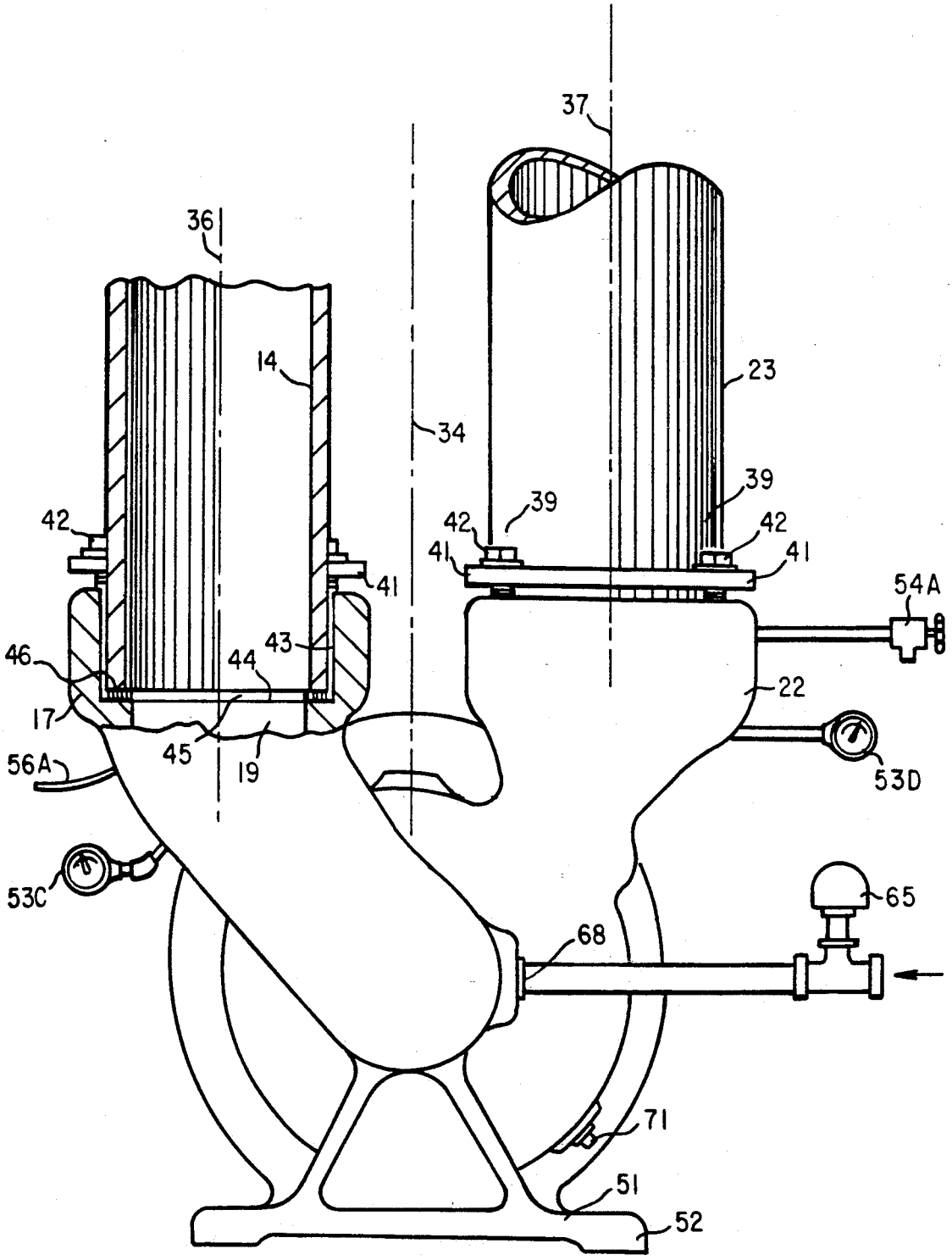
FIG. 2 is an enlarged elevational view of the pump intake end of the pump and heat exchanger assembly.

The pump case 18 is generally circular about a horizontal axis 21 (FIGS. 4 and 5) lying in a vertical plane 34 (FIG. 2). The axis 21 is the axis of the volute 25 (FIG. 3) in which the impeller (not shown) resides and rotates. The tank receivers 17 and 22 are generally cylindrical as are the tanks 14 and 23. and their axes 36 and 37 lie in a vertical plane 38 (FIGS. 4 and 5) which is perpendicular to the pump axis 21 as the lower portion of each tank is inserted as at 39 in FIG. 2 for tank 23, into the tube receiver 22. The tank axes 36 and 37 are equally spaced from and on opposite sides of the plane 34.

Figure 5:
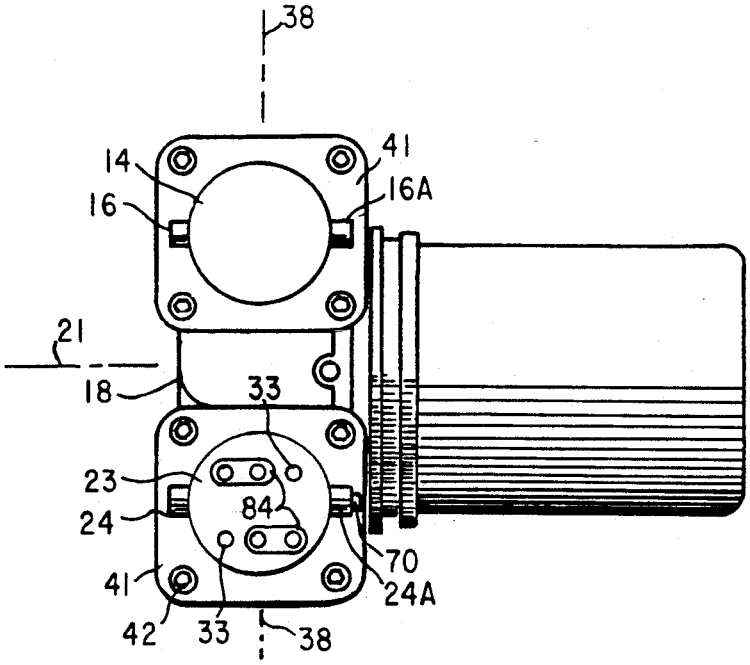
FIG. 5 is a top plan view of the same scale as FIG. 4.

A flange 41 is welded to the exterior of tank 23. It is apertured at the four corners and receives the stem of a cap screw 42 at each corner and which is screwed into the pump case at four corners of a square around the receptacle receiving the tank (FIG. 5). Exactly the same type of mounting is provided for tank 14 as shown for tank 23. Therefore, a description of the sealing of tank 14 will suffice also for tank 23. In this case, there is an upwardly opening cylindrical bore 43 in the receptacle 17 and which receives the tank 14 in a loose sliding fit. A radially inward extending shoulder 44 at the bottom of bore 43 receives and supports an elastomeric seal ring 45 of rectangular cross section therein. The lower end 46 of the tank 14 is disposed on top of the seal 45. It seals completely around the end of the tank when the cap screws 42 are screwed into the pump case at the four corners around the tank 14.

The rear of the pump case has a double flanged adaptor 47 secured to it by circularly spaced cap screws (not shown) bearing on flange 47A. The pump drive motor 48 is secured to the adaptor by a series of circularly spaced cap screws (not shown) bearing on flange 47B. The pump case has a rectangular mounting base 51 with four bolt holes in the corners thereof as at 52 to receive bolts to mount it to a mounting pad in either a stationary unit or a mobile cabinet. This arrangement is sufficient to support the motor 48 without any brace at the outer end of the motor.

Figure 3:
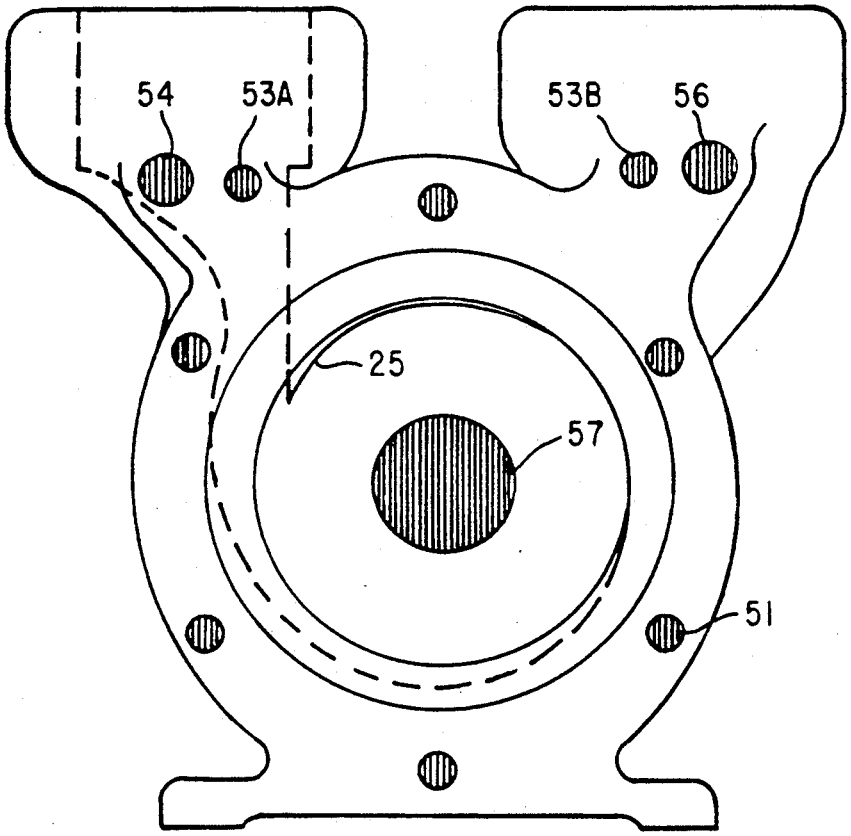
FIG. 3 is an elevational view of the motor end of the pump case but omitting the motor, adaptor plate and pump impeller.
Figure 7:
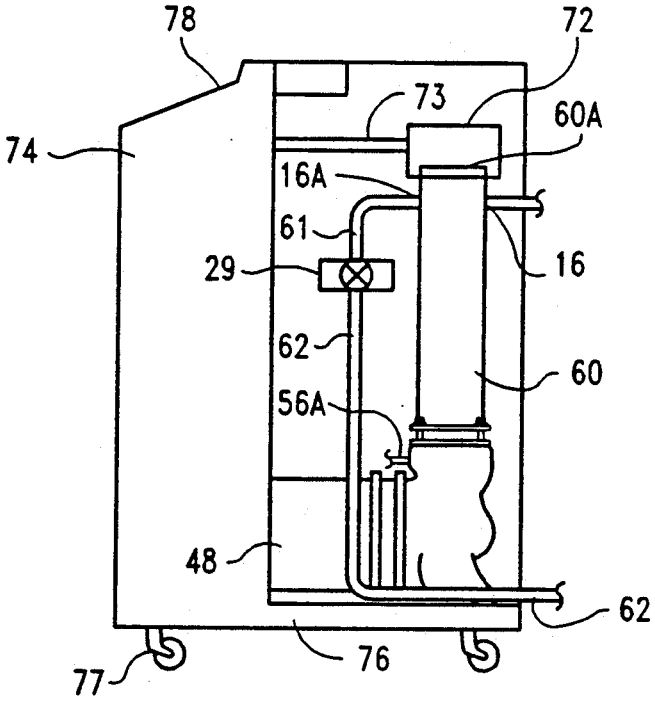
FIG. 7 is a side elevational view thereof.

In FIG. 3, where the front of the pump case is shown with the motor and adaptor removed from it, the tapped bolt holes 51 are shown in a circle of six. Additional tapped holes are shown at 53A and 53B for connection to input and output pressure gauges 53C and 53D, respectively, shown in FIG. 2. A tapped hole 54 is provided for a pressure relief valve 54A (FIG. 2). The tapped hole 56 is provided for connection of a "from process" temperature sensor probe 56A (FIG. 7). The central opening 57 on the pump axis is shown with vertical linework, as are the tapped holes, to indicate a hole, not a screen.

Figure 6:
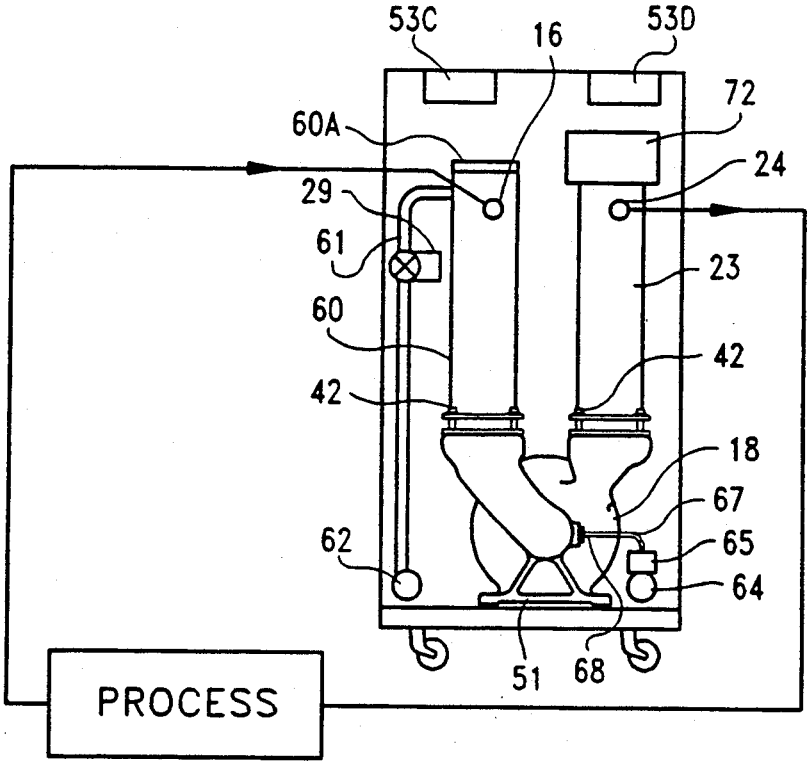
FIG. 6 is a rear end elevational view of a complete machine employing the pump and heat exchanger assembly of the present invention in an "open circuit" process water system.

Referring now to FIGS. 6 and 7, there is shown an "open circuit" embodiment of the invention. At this time, usage of the present invention in open circuit systems is expected to be more frequent than in closed circuit systems. In this case, instead of using a separate tube and shell heat exchanger as mentioned above, or a separate coil such as 26 of FIG. 1, for the cooling water, the cooling is achieved, when necessary, by discharging process water to waste drain and supplying fresh water from a public utility, for example, directly into the process water circuit. In this embodiment, the pump case may be exactly the same as in the previously described embodiment. It is shown with a slightly more specifically defined flange at the top of the pump case where the tank receiver receptacles are located. Tank 23 is identical and is mounted in an identical fashion with the cap screws 42. In this embodiment, the tank 60 at the intake side of the pump is similar to that at the pump discharge side but, instead of having an electrical junction box 72 at the top, it has a plate 60A welded to the top. The mounting of the tank to the pump case is the same as previously described with reference to tank 14 in the first embodiment. In this instance however, the suction tank 60 at the pump input side and which receives the water from the process through line 13, has an outlet line 61 connected to a spud opening 16A at the back of the tank 60 directly behind inlet opening 16 at the front. This line 61 is connected through electrically controlled valve assembly 29 which is normally closed. The outlet side of the valve at 62 is at the rear of the machine for connection to a waste drain just as the valve 29 in the FIG. 1 embodiment discharges waste water to a sewer. Make-up water from a city water supply as at 28 in FIG. 1, is supplied through input line 64 and a tee fitting for pressure switch 65, and the supply line 67 into the threaded hole 68 at the bottom of the intake passageway of the pump case. Switch 65 is an enabling switch which is closed unless there is sufficient make-up water pressure for the system to operate correctly. The pump case drain opening is plugged with a plug 71 in this embodiment just as in the previous embodiment.

A "to process" temperature probe 70 is mounted in a spud as at 24A (FIG. 5) in tank 23 diametrically opposite the tank outlet spud 24. As mentioned above, "from process" temperature probe 56A (FIG. 7) is mounted in the tapped hole 56 (FIG. 3) in the pump case.

If it is desired to double the heating capacity of the unit, a heat exchanger tube identical to 23 can be installed in place of tube 60 and each may have a junction box 72 at the upper end thereof, both of which would be connected as by a line 73 into the control cabinet 74. All of this apparatus is mounted on a base 76 which, in this embodiment, is mounted on four caster assemblies 77. As in the first described embodiment, the pump case itself provides the total support for the motor 48, without any additional support at the outer end of the motor, part of which is extending inside the cabinet 74 as best shown in FIG. 7. The cabinet may have a control panel 78 at the top front, and the two pressure gauges 53C and 53D in the top of the cabinet are readily observable to the operator. These may be connected as by pilot lines to the threaded ports 53A and 53B described above with reference to FIG. 3.

The pump case is cast iron but could be brass or other material. The tubes 14, 23, 60 are steel but could be stainless or other material. The whole unit is much smaller than others known to us for a given heating capacity. By using 9 KW heating elements in each tank, the machine can have 18 KW heating capacity using a 3 inch diameter tube about 14 inches long for each of the tank locations. In this 18 KW version a pump capacity up to 3 horsepower can be employed. The tanks 23 in both receptacles 17 and 22 may be referred to as modular heater tanks. The general construction of one of them is shown in more detail in FIGS. 8 and 9.

Figure 9:
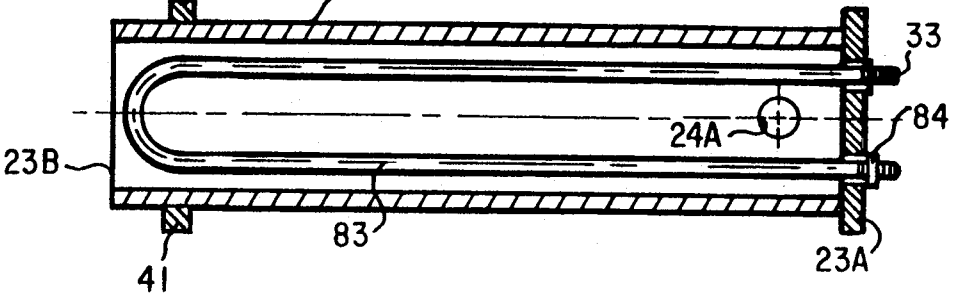
FIG. 9 is a longitudinal section therethrough taken at line 9—9 in FIG. 8 and viewed in the direction of the arrows.
Figure 8:
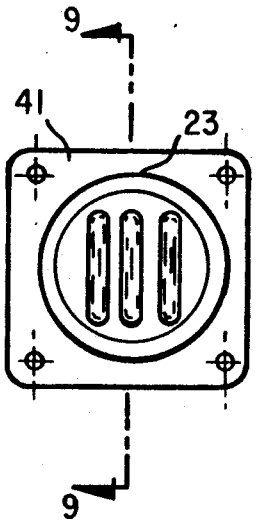
FIG. 8 is a bottom plan view of the heater tank 23 on the same scale as in FIG. 5.

As shown in FIGS. 8 and 9 considered along with the top view of the heater tank 23 shown in FIG. 5, it can be seen that the heater tank is actually a hollow cylinder which has a header 23A welded to one end of it. It is open at the other end. Three U-shaped heating element tubes 83 (six might be used in some cases) are mounted and anchored in and suitably insulated from the header plate 23A and extend from there to a point near the open end 23B of the tube 23. At the top end of each of these heater element tubes, and electrically insulated therefrom a threaded terminal post 33 is provided. One of each of these is connected from one of the two ends of the middle element to one end of either of the outer elements. The open terminals at the outer elements are available for connection of the power supply source inside the junction box 72 as mentioned above. The mounting flange 41 is welded to the outer surface of the tube 23.

When one of these heater units or tanks fails, due to accumulation of lime deposits on the elements 83 themselves or on the tank walls or otherwise, instead of removing the heater elements 83 from the tank 23, the whole assembly as shown in FIGS. 8 and 9, can be removed by simply removing four cap screws 42 from the pump case. It can then be replaced with a new one.

Figure 10:
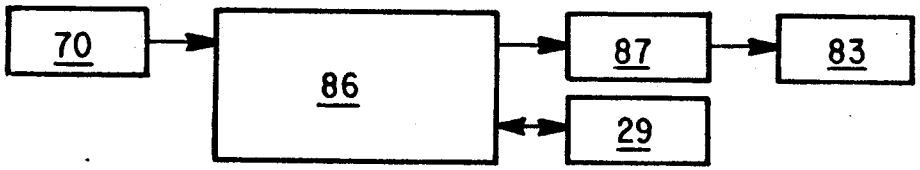
FIG. 10 is an electrical block diagram of the system.

Referring now to FIG. 10, a microcomputer 86 located in the cabinet 74 has a temperature input from the "to process" temperature sensor 70. It has both an input from and output to the modulator valve assembly 29 (in both the FIG. 1 version and the FIG. 6, 7 version). It responds to the temperature input to produce an output to the modulator valve assembly 29 as needed to increase or decrease the amount of water discharged to waste while, at the same time, water main pressure at the inlet (64 in this version; 28 in the FIG. 1 version) provides all make-up water that is necessary. Typically this water is colder than the process and thereby helps hold the process temperature down to the desired level. If the "to process" temperature is too low, the controller will close the valve and apply a signal to the heater relay 87 to energize the heater elements 83.

The modular valve operating motor is a stepper motor which is geared down to provide six thousand steps for 90° of rotation of the modulating ball valve. Having the location of the spud opening connected through the modulating valve to the drain at a location near the top of the tank 60, provides a good way to remove any entrained air from the system since, as this valve 29 opens, the fresh water at water main pressure enters the suction side of the pump and maintains the pressure which will drive the air from the top of tank 60 through the modulator valve to drain. As mentioned above, the pressure switch 65 enables the system to operate only when there is sufficient pressure to operate the system above the water boiling point pressure. It thus provides protection for both the heaters and the pump.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A heat transfer apparatus comprising:

a pump assembly having a case with a drive member having an axis;

the case having circular tube receivers having centers in a first plane perpendicular to the axis, the centers being on opposite sides of a second plane containing the axis;

a first tube received in one of the receivers and having heater means therein, the tube having at least one plate projecting outward; and fastener means mounted to the case and to the plate to secure the tube in the one receiver.

2. The apparatus of claim 1 and further comprising:

a shoulder in the one receiver;

a seal ring on the shoulder and compressed by the end of the tube and sealing the end of the tube to the case in the receiver.

3. The apparatus of claim 2 and wherein:

the plate projects radially outwardly from the first tube; and additional fastener means engage the plate and case at circularly spaced locations around the first tube and secure the first tube to the case.

4. The apparatus of claim 3 wherein:

said fastener means are screws threaded into the case and pulling the first tube into tight sealing engagement with the seal ring.

5. The apparatus of claim 1 and further comprising:

a second tube received in another of the receivers and having at least one bracket projecting outward; and further fastener means mounted to the case and to the bracket and securing the second tube in the other receiver.

6. The apparatus of claim 5 and further comprising:

an upwardly facing shoulder in the other receiver;

a second seal ring on the shoulder in the groove in the other receiver and compressed by the end of the second tube and sealing the end of the second tube to the case in the other receiver.

7. A heat transfer apparatus comprising:

a pump assembly having a case with a drive member having an axis;

the case having circular tube receivers having centers in a first plane perpendicular to the axis, the centers being on opposite sides of a second plane containing the axis;

a first tube received in one of the receivers and having heater means therein, the tube having at least one plate projecting outward;

fastener means mounted to the case and to the plate to secure the tube in the one receiver;

a shoulder in the one receiver;

a seal ring in the shoulder and compressed by the end of the tube and sealing the end of the tube to the case in the receiver;

a second tube received in another of the receivers and having at least one bracket projecting outward;

further fastener means mounted to the case and to the bracket and securing the second tube in the other receiver;

an upwardly facing shoulder in the other receiver;

a second seal ring on the shoulder in the groove in the other receiver and compressed by the end of the second tube and sealing the end of the second tube to the case in the other receiver; and a pair of spuds at diametrically opposite locations in said second tube near the top of said second tube.

8. The apparatus of claim 1 and further comprising:

a base;

a cabinet mounted on the base, and the pump case being mounted on the base.

9. The apparatus of claim 8 and wherein:

the pump case includes a volute and the axis is horizontal;

the tube receivers face upwardly;

the first plane is vertical;

the second plane is vertical;

the plate projects horizontally from the first tube; and the apparatus further comprises:

a pump drive motor fastened to the case and having a motor axis colinear with the volute axis, the pump motor being supported exclusively by the pump case.

10. In a heat transfer system, the combination comprising:

a case having a pump intake passageway and a pump discharge passageway;

a first tube receiver on the case and communicating with one of the passageways;

a first tube received in the receiver and having a heater inside the tube; and a releaseable fastener removably securing the tube to the case.

11. The combination of claim 10 and further comprising:

a tube discharge port in the first tube at a location remote from the receiver.

12. The combination of claim 11 and further comprising:

a second tube receiver on the case and communicating with the other one of the passageways;

a second tube received in the second receiver; and a releaseable fastener removably securing the second tube to the case.

13. The combination of claim 12 and further comprising:

a tube discharge port in the second tube at a location remote from the second receiver.

14. In a heat transfer system, the combination comprising:

a case having a pump intake passageway and a pump discharge passageway;

a first tube receiver on the case and communicating with one of the passageways;

a first tube received in the receiver and having a heater inside the tube;

a releaseable fastener removably securing the tube to the case;

a tube discharge port in the first tube at a location remote from the receiver;

a second tube receiver on the case and communicating with the other one of the passageways;

a second tube received in the second receiver;

a releaseable fastener removably securing the second tube to the case;

a tube discharge port in the second tube at a location remote from the second receiver;

a modulator valve having an inlet associated with the second tube discharge port and an outlet to waste;

a temperature sensor for fluid passing through the first tube to the discharge port for delivery to a process;

a controller coupled to the temperature sensor and to the modulator valve and operable in response to increasing temperature in the first tube to operate the valve to increase flow from the second discharge port to waste.

15. The combination of claim 14 and wherein:

the discharge port in the second tube is located adjacent a high point in the combination thereby facilitating priority discharge through the valve to waste, of air and vapor in the combination.

16. The combination of claim 14 and wherein:

the controller includes a microcomputer.

17. The combination of claim 16 and further comprising:

a digital drive motor coupled to the computer and to the modulator valve.

18. A heat transfer system comprising:

the combination of claim 14; and a process using circulating water for process equipment temperature control and having an inlet and an outlet;

the first tube having a discharge port coupled to the process inlet for delivering water from the pump discharge passageway to the process inlet;

the second tube having an inlet port coupled to the process outlet for receiving water from the process and delivering received water through the second tube to the pump intake passageway.

19. The system of claim 18 and wherein:

the controller being coupled to the heater for activating the heater in response to sensing temperature below a predetermined level.

20. The system of claim 19 and further comprising:

a pump fastened to the case and having an intake communicating with the intake passageway and having an outlet communicating with the discharge passageway; and wheels supporting the combination of claim 14, the controller, drive motor, temperature sensor and pump for mobility thereof relative to the process.

* * * * *